US009989913B2

(12) United States Patent
Nakane et al.

(10) Patent No.: US 9,989,913 B2
(45) Date of Patent: Jun. 5, 2018

(54) CLEANING DEVICE WHICH REMOVES ADHERED SUBSTANCES ON IMAGE SUPPORTING BODY

(71) Applicant: Konica Minolta, Inc., Chiyoda-ku, Tokyo (JP)

(72) Inventors: Yoshiki Nakane, Toyokawashi (JP); Takuya Okada, Toyokawashi (JP); Junji Murauchi, Toyokawashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days. days.

(21) Appl. No.: 15/405,380

(22) Filed: Jan. 13, 2017

(65) Prior Publication Data

US 2017/0205759 A1 Jul. 20, 2017

(30) Foreign Application Priority Data

Jan. 14, 2016 (JP) ..... 2016-005148

(51) Int. Cl.
*G03G 21/00* (2006.01)
*B08B 1/04* (2006.01)
*B08B 1/00* (2006.01)

(52) U.S. Cl.
CPC ..... *G03G 21/0029* (2013.01); *B08B 1/005* (2013.01); *B08B 1/04* (2013.01)

(58) Field of Classification Search
CPC ..... G03G 21/0029; B08B 1/04; B08B 1/005; B65G 45/16
USPC ..... 399/351, 350
See application file for complete search history.

(56) References Cited

U.S. PATENT DOCUMENTS 8,750,749 B2 * 6/2014 Suzuki et al. ..... 399/101
2003/0113145 A1 * 6/2003 Okabayashi ..... G03G 21/0029 399/350
2008/0063448 A1 * 3/2008 Hozumi et al. ..... 399/350
2010/0067945 A1 * 3/2010 Hozumi et al. ..... 399/111
2012/0008974 A1 * 1/2012 Kawai ..... G03G 15/0806 399/71
2013/0108321 A1 * 5/2013 Uyama ..... G03G 21/12 399/123

FOREIGN PATENT DOCUMENTS

JP 2-150885 A 6/1990
JP 2010-008776 A 1/2010

* cited by examiner

*Primary Examiner* — Walter L Lindsay, Jr.
*Assistant Examiner* — Arlene Heredia Ocasio
(74) *Attorney, Agent, or Firm* — Buchanan Ingersoll & Rooney PC

(57) ABSTRACT

A photo conductor cleaning device removes substances adhered to a surface of a photo conductor which moves around the axis of rotation. The photo conductor cleaning device is equipped with a device main body, a tip blade, and a flexible supporting sheet metal plate which holds the tip blade and makes the tip blade contact with the photo conductor. The supporting sheet metal plate is fixed to the device main body by two fixing portions which are places at different locations, as seen from a cross section perpendicular to the axis of rotation of the photo conductor. The supporting sheet metal plate is supported at the both ends by the two fixing portions support.

10 Claims, 13 Drawing Sheets

FIG. 10

COMPARATIVE EXAMPLE A

| | COVERAGE | ENVIRONMENT | EVALUATION TIMING | PHOTO CONDUCTOR ABRASION | TIP BLADE ABRASION | FOGGING | CARRIER ADHESION | PRODUCING SOUND | PEELING | CONTACT |
|---|---|---|---|---|---|---|---|---|---|---|
| CONDITION 1 | 1% | 23°C × 65%RH | AFTER150,000 | C | C | A | C | – | – | – |
| CONDITION 2 | 5% | 23°C × 65%RH | AFTER150,000 | A | A | A | A | – | – | – |
| CONDITION 3 | 25% | 23°C × 65%RH | AFTER150,000 | AA | A | B | A | – | – | – |
| CONDITION 4 | 0% | 30°C × 85%RH | 0～100 | – | – | – | – | C | – | – |
| CONDITION 5 | 0% | 30°C × 85%RH | 101～200 | – | – | – | – | C | – | – |
| CONDITION 6 | 0% | 30°C × 85%RH | AFTER 200 | – | – | – | – | – | A | C |

FIG. 11

COMPARATIVE EXAMPLE B

| | COVERAGE | ENVIRONMENT | EVALUATION TIMING | PHOTO CONDUCTOR ABRASION | TIP BLADE ABRASION | FOGGING | CARRIER ADHESION | PRODUCING SOUND | PEELING | CONTACT |
|---|---|---|---|---|---|---|---|---|---|---|
| CONDITION 1 | 1% | 23°C × 65%RH | AFTER150,000 | AA | A | B | A | – | – | – |
| CONDITION 2 | 5% | 23°C × 65%RH | AFTER150,000 | A | A | A | A | – | – | – |
| CONDITION 3 | 25% | 23°C × 65%RH | AFTER150,000 | AA | A | C | A | – | – | – |
| CONDITION 4 | 0% | 30°C × 85%RH | 0～100 | – | – | – | – | A | – | – |
| CONDITION 5 | 0% | 30°C × 85%RH | 101～200 | – | – | – | – | C | – | – |
| CONDITION 6 | 0% | 30°C × 85%RH | AFTER 200 | – | – | – | – | – | A | A |

FIG. 12

INVENTION EXAMPLE C

| | COVERAGE | ENVIRONMENT | EVALUATION TIMING | PHOTO CONDUCTOR ABRASION | TIP BLADE ABRASION | FOGGING | CARRIER ADHESION | PRODUCING SOUND | PEELING | CONTACT |
|---|---|---|---|---|---|---|---|---|---|---|
| CONDITION 1 | 1% | 23°C × 65%RH | AFTER150,000 | A | A | A | A | – | – | – |
| CONDITION 2 | 5% | 23°C × 65%RH | AFTER150,000 | A | A | A | A | – | – | – |
| CONDITION 3 | 25% | 23°C × 65%RH | AFTER150,000 | A | A | A | A | – | – | – |
| CONDITION 4 | 0% | 30°C × 85%RH | 0～100 | – | – | – | – | A | – | – |
| CONDITION 5 | 0% | 30°C × 85%RH | 101～200 | – | – | – | – | B | – | – |
| CONDITION 6 | 0% | 30°C × 85%RH | AFTER 200 | – | – | – | – | – | A | A |

FIG. 13

INVENTION EXAMPLE D

| | COVERAGE | ENVIRONMENT | EVALUATION TIMING | PHOTO CONDUCTOR ABRASION | TIP BLADE ABRASION | FOGGING | CARRIER ADHESION | PRODUCING SOUND | PEELING | CONTACT |
|---|---|---|---|---|---|---|---|---|---|---|
| CONDITION 1 | 1% | 23°C × 65%RH | AFTER150,000 | A | A | A | A | – | – | – |
| CONDITION 2 | 5% | 23°C × 65%RH | AFTER150,000 | A | A | A | A | – | – | – |
| CONDITION 3 | 25% | 23°C × 65%RH | AFTER150,000 | A | A | A | A | – | – | – |
| CONDITION 4 | 0% | 30°C × 85%RH | 0～100 | – | – | – | – | A | – | – |
| CONDITION 5 | 0% | 30°C × 85%RH | 101～200 | – | – | – | – | A | – | – |
| CONDITION 6 | 0% | 30°C × 85%RH | AFTER 200 | – | – | – | – | – | A | A |

CLEANING DEVICE WHICH REMOVES ADHERED SUBSTANCES ON IMAGE SUPPORTING BODY

The present U.S. patent application claims a priority under the Paris Convention of Japanese patent application No. 2016-005148 filed or Jan. 14, 2016, the entirety of which is incorporated herein by references.

BACKGROUND OF THE INVENTION

Field of the Invention

This invention relates to a cleaning device. More specifically, this invention relates to a cleaning device which removes adhered substances on the surface of an image supporting body.

Description of the Related Art

As electrophotography image forming apparatuses, there are an MFP (Multi Function Peripheral) which has a scanner function, a facsimile function, a copying function a function of a printer, a data transmitting function and a server function, a facsimile device, a copying machine, a printer, and so on.

An image forming apparatus typically includes an image supporting body, an electrostatic charging unit, an expose unit, a developing unit, a transfer conveying unit, a cleaning device, a fixing portion, and so on. The image supporting body is cylindrical and rotatable. The electrostatic charging unit electrostatically charges the surface of the image supporting body uniformly. The expose unit exposes the image supporting body to generate an electrostatic latent image. The developing unit consists of a developer tank which stores toner, and a developing sleeve. The developing unit develops a toner image on the electrostatic latent image, by difference between electrical potential of the developing sleeve and electrical potential of the electrostatic latent image. The transfer conveying unit is placed facing the photo conductor, and electrical voltage of which the polarity is opposite to the toner image is applied to the transfer conveying unit. The transfer conveying unit conveys a transferring body such as a paper sheet, with transferring the toner image on the surface of the image supporting body to the transferring body. The cleaning device consists of a supporting part made of metal or the like, and an elastic body which is attached to the supporting part. The cleaning device scrapes off transfer remaining toner which was not transferred onto the transferring body and remains on the surface of the image supporting body. The fixing portion fixes the toner image on the transferring body, by applying heat and pressure to the toner image transferred onto the transferring body.

Recently, to reduce a downtime of an image forming apparatus, life prolongation of an image supporting body and a cleaning device is requested. When life prolongation of the image supporting body and the cleaning device is achieved, the number of times of replacement of the image supporting body and the cleaning device is reduced, and the downtime of the image forming apparatus can be reduced. As for the image supporting body and the cleaning device, the abrasion amount is an obstacle for life prolongation. When the abrasion amount exceeds a constant amount, they cannot exhibit the required functions. In such the case, the consumed component should be replaced with new one.

To reduce abrasion of the image supporting body and the cleaning device, it is effective to reduce stress which occurs at a contact portion between the elastic body and the image supporting body by reducing the contacting force of the elastic body of the cleaning device against the image supporting body. On the other hand, when the contacting force is too weak, the inhibiting power by which the cleaning device inhibits toner decreases. In such the case, cleaning failure is likely to occur. To decrease the abrasion of the image supporting body and the cleaning device and prevent the cleaning failure, the contacting force should be reduced, with decreasing variation of the contacting forces among cleaning devices.

At present, cleaning devices which are mainly used adopt a structure in which a rigid body is used as a supporting part, and a strip shaped polyurethane rubber component is used as an elastic body. According to the cleaning device having this structure, when the cleaning device makes contact with the image supporting body, the elastic body is elastically deformed. The repulsion of the elastic body is applied to the image supporting body as the contacting force.

According to the above-mentioned structure of the cleaning device, there is a lot of variation in reaction forces of the elastic bodies, caused by the variation of the deformation amounts of the elastic bodies and the Young's moduli. Hence, there is a problem in which there is a lot of variation in the contacting forces which make the elastic bodies contact with the image supporting bodies. Further, since polyurethane rubber has viscosity, when polyurethane rubber is pressed over the long term, permanent strain occurs in the elastic body. It degrades the cleaning power.

A cleaning device is proposed, in which a plate spring or the like is used as a supporting part, to give the supporting part flexibility and decrease the spring constant value of the supporting part. According to the cleaning device, when the elastic body makes contact with the image supporting body, both the elastic body and the supporting part become deformed. The variation in Young's moduli of metals is small, being different from characteristics of rubber. When the spring constant value of the rubber is small, peeling (buckling of the tip blade) occurs by the contacting force. Hence, it is difficult to decrease the spring constant value of the rubber. However, even though the spring constant value of the metal decreased, peeling does not occur in the metal. Therefore, it is easy to decrease the spring constant value of the metal. Hence, the variation of the contacting forces which make the elastic body contact with the image supporting body can be small, by applying flexibility to the supporting part, even though there is variation in deformation amounts of the supporting parts when the elastic body makes contact with the image supporting body. Further, since metal does not have viscosity, permanent strain does not occur in the metal.

An image forming apparatus uses toner to which lubricant is added. When toner is supplied to the image supporting body, and the toner passes through a nip portion between the image supporting body and the elastic body of the cleaning device, the lubricant becomes a coated layer. Hence, lubricating ability of the image supporting body improves. Herewith, frictional force acting between the toner and the image supporting body is reduced, and the cleaning performance of the cleaning device improves.

The supplied amount of lubricant to the image supporting body changes based on the toner amount being supplied to the image supporting body, i.e. the coverage of the document to be printed. Therefore, when the coverage of the document to be printed fluctuates, the friction coefficient of the image supporting body fluctuates, and the frictional force between the image supporting body and the elastic body fluctuates too. In consequence, the frictional force between the image supporting body and the elastic body changes based on the coverage of the document to be printed.

Especially, according to a cleaning device which includes a supporting part of which the spring constant value is small, when the frictional force between the image supporting body and the elastic body increases, it becomes easier for the supporting part to be deformed. In consequence, the contacting force which makes the elastic body contact with the image supporting body increases, so that it has a problem in that the lifeline of the image supporting body and the cleaning device shortens.

Further, when the supporting part is deformed, the oscillation of the supporting part increases. Then, there is a risk that a sound (abnormal noise) is produced, and the supporting part makes contact with the image supporting body to damage the image supporting body.

Documents 1 and 2 below discloses conventional cleaning devices, for example. The Document 1 discloses a cleaning device which includes a blade which makes contact with a surface of a photo conductor with pressure, supporting part to which the blade is fixed at the leading end, and a plate spring which makes the blade contact with the surface of the photo conductor with pressure via the leading end of the supporting part. The spring constant value of the plate spring is larger than the spring constant value of the supporting part.

The Document 3 below discloses a cleaning device which includes an elastic blade being pressed in an axial direction of a photo conductor, and a blade holder which holds the blade in the device main body. According to the cleaning device, the blade holder consists of a holder head which holds the blade, and a holder main body part which holds the holder head. The holder main body part is supported by the device main body via a shaft. The both ends of the elongated direction of the holder head is swingably about the axis of rotation of the head with respect to the holder main body, in directions opposite to each other.

[Document 1] Japan Patent Publication No. (HEI) 2-150885

[Document 2] Japan Patent Publication No. 2010-8776

According to the technique of Document 1, even though the frictional force between the photo conductor and the blade increases, the supporting part is pressed against the photo conductor by the plate spring. Hence, the blade is prevented from peeling. However, with increment of the frictional force between the photo conductor and the blade, the length of the leading end of the blade which is drawn into the rotation of the photo conductor increases, so that the contacting force which makes the blade contact with the photo conductor increases. In consequence, abrasion of the photo conductor and the blade increases, so that the lifetime of the photo conductor and the cleaning device shortens.

According to the cleaning device of Document 2, when the frictional force between the photo conductor and the blade increases, there is not a component which suppresses the force which occurs around its axis in the swing direction. Therefore, the contacting force which makes the blade contact with the photo conductor increases, and abrasion of the photo conductor and the blade increases, so that the lifetime of the photo conductor and the cleaning device shortens.

As described above, techniques described in Documents 1 and 2 have problems in that when frictional force between the image supporting body and the cleaning unit fluctuates, the contacting force which makes the elastic body contact with the image supporting body fluctuates too. Therefore, techniques described in Documents 1 and 2 have problems in which the abrasion amounts of the image supporting body and the cleaning unit fluctuate.

Namely, the problem in which the lifetime of the cleaning device shortens still remains in techniques described in Documents 1 and 2.

SUMMARY OF THE INVENTION

This invention is to solve the above problems. The object is to provide a cleaning device which can perform life prolongation of an image supporting body and a cleaning device.

Another object of this invention is to provide a sophisticated cleaning device.

To achieve at least one of the abovementioned objects, according to an aspect, a cleaning device reflecting one aspect of the present invention is for removing substances adhered to a surface of an image supporting body, wherein the image supporting body moves around an axis of rotation, comprising: a cleaning device main body, an elastic component, and a supporting part which is flexible, holds the elastic component, and makes the elastic component contact with the image supporting body, wherein the supporting part is fixed to the cleaning device main body by two fixing portions which are located at different locations, as seen in a cross section perpendicular to the axis of rotation, and the supporting part is supported at both ends of the supporting part by the two fixing portions.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 10 shows the evaluation, result table of comparative example A, according to the embodiment of this invention.

FIG. 11 shows the evaluation result table of comparative example B, according to the embodiment of this invention.

FIG. 12 shows the evaluation result table of the invention example C, according to the embodiment of this invention.

FIG. 13 shows the evaluation result table of the invention example D, according to the embodiment of this invention.

DESCRIPTION OF THE PREFERRED EMBODIMENTS

Hereinafter, an embodiment of the present invention will be described with reference to the drawings. However, the scope of the invention is not limited to the illustrated examples.

In the following embodiments, an image forming apparatus equipped with a cleaning device as an MFP will be explained. The image forming apparatus equipped with the cleaning device may be a facsimile device, a copying machine, a printer, or the like.

The First Embodiment

Figure 1:
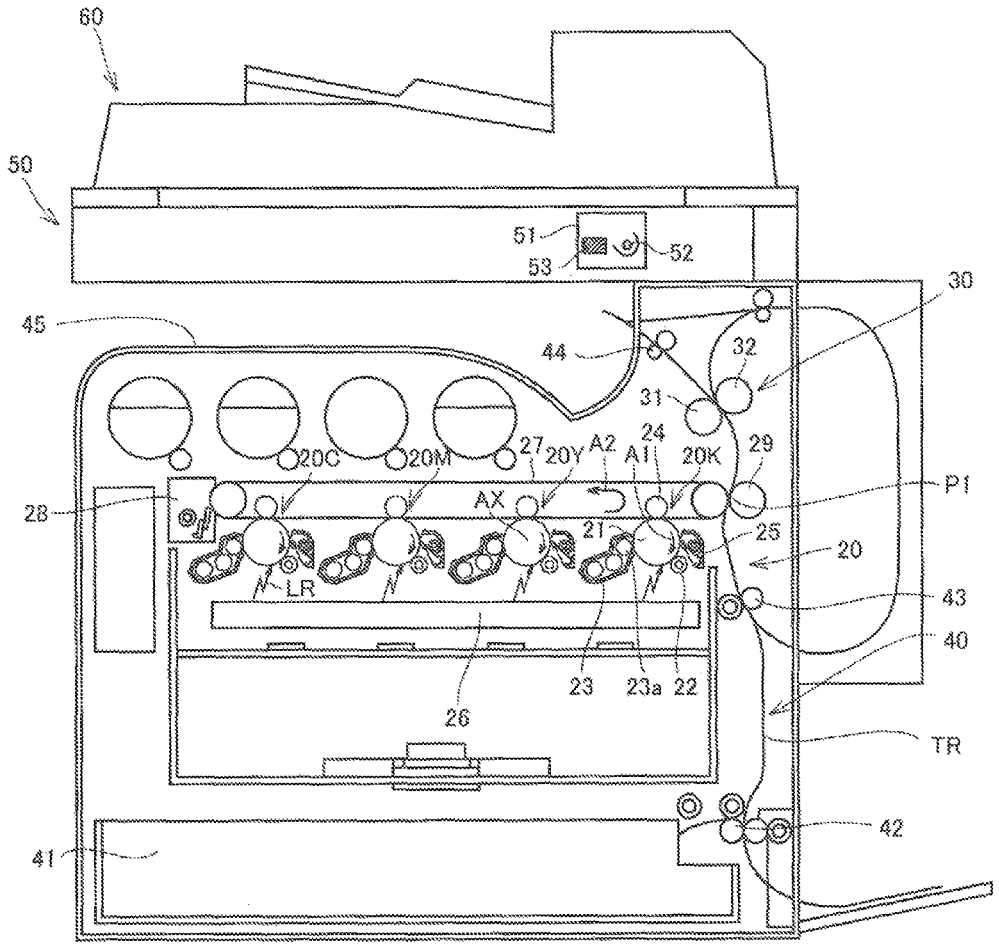
FIG. 1 shows a cross sectional diagram of a structure of an image forming apparatus equipped with a cleaning device, according to the first embodiment of this invention.

FIG. 1 shows a cross sectional diagram of a structure of an image forming apparatus equipped with a cleaning device, according to the first embodiment of this invention. FIGS. 1 to 9 show cross sections, wherein the axis AX of rotation of photo conductor 21 is perpendicular to the cross sections.

Referring to FIG. 1, the image forming apparatus according to the embodiment includes toner image forming unit 20, fixing device 30, sheet conveying unit 40, scanner 50, and ADF (Auto Document Feeder) 60.

Toner image forming unit 20 synthesizes a four-colored image by a so-called tandem system, and transfers the toner image onto a sheet. Toner image forming unit 20 includes drum units 20C, 20M, 20Y and 20K for colors of C (cyan), M (magenta), Y (yellow) and K (black), primary transfer rollers 24, expose device 26, intermediate transfer belt 27, intermediate transfer cleaning device 28, secondary transfer roller 29, and so on. Primary transfer rollers 24 are provided for colors of CMYK.

Each of drum units 20C, 20M, 20Y and 20K includes photo conductor 21 (an example of an image supporting body), electrostatic charging device 22, developing device 23, and photo conductor cleaning device 25 (an example of a cleaning device). Photo conductor 21 rotates (moves) in the direction shown by arrow A1, around the axis AX of the rotation. Electrostatic charging device 22 electrostatically charges the surface of photo conductor 21 uniformly with a minus polarity. Expose device 26 emits writing lights (image exposures) LR being modulated by image data, for form an electrostatic latent image on the surface of each of photo conductors 21. Developing device 23 develops the electrostatic latent image with toner frictionally electrified by a minus polarity, to form the toner image on the surface of photo conductor 21. Electrical voltage (developing bias) of a minus polarity is applied to developing roller 23*b* of developing device 23. Developing roller 23*b* of developing device 23 performs reverse developing for selectively developing the surface of photo conductor 21 of which the electrical potential is reduced by the exposure. Primary transfer roller 24 electrostatically transfers the toner image to intermediate transfer belt 27, by electrical voltage (transfer bias) of a plus polarity applied to primary transfer roller 24.

The toner images formed by drum units for colors are transferred to the surface of intermediate transfer belt 27 in series, so that a full color image is finally formed. Intermediate transfer belt 27 rotates in the direction shown by arrow A2, to convey the full color image to image forming location P1. Secondary transfer roller 29 transfers the toner image from intermediate transfer belt 27 to a sheet, at image forming location P1.

Van de Waals' force is applied between photo conductor 21 and toner. Toner which cannot be electrostatically transferred by primary transfer roller 24 (so-called transfer remaining toner, which is an example of adhered substances) remains on the surface of photo conductor 21. Photo conductor cleaning device 25 scrapes the transfer remaining toner by using blade 5 (FIG. 2), to remove (collect) the transfer remaining toner. Photo conductor cleaning device 25 also erases electrostatic latent image which remains on the surface of photo conductor 21 by using neutralization device 6 (FIG. 2) which exposes the whole area. After the toner image was transferred, intermediate transfer cleaning device removes toner which remains on the surface of intermediate transfer belt 27.

Fixing device 30 heats and applies pressure on toner adhered to a sheet, to fix the toner on the sheet, and forms an image on the sheet. Fixing device 30 includes fixing roller 31 and pressure roller 32.

Sheet conveying unit 40 includes paper feeding cartridge 41, separate unit 42, a pair of conveying rollers 43, a pair of discharge rollers 44, copy receiving tray 45, and so on. Paper feeding cartridge 41 stores sheets on which images are to be formed. Paper feeding cartridge 41 may include a plurality of paper feeding cartridges. Separate unit 42 separates one sheet from a plurality of sheets stored in paper feeding cartridge 41, and feeds the paper sheet to conveying path TR. The pair of conveying rollers 43 conveys the sheet along with conveying path TR. The pair of discharge rollers 44 discharges the sheet on which an image was formed to copy receiving tray 45.

Scanner 50 is placed between ADF 60 and copy receiving tray 45. Scanner 50 includes IR (infrared) module 51 and so on. IR module 51 includes lamp 52 to irradiate a document with light, and image sensor 53 to receive reflected light from the document. IR module 51 reads the document image to acquire the image data.

ADF 60 is provided at an upper part of the image forming apparatus. ADF 60 conveys a document on which an image is to be read by scanner 50, to an image reading location of scanner 50.

Figure 2:
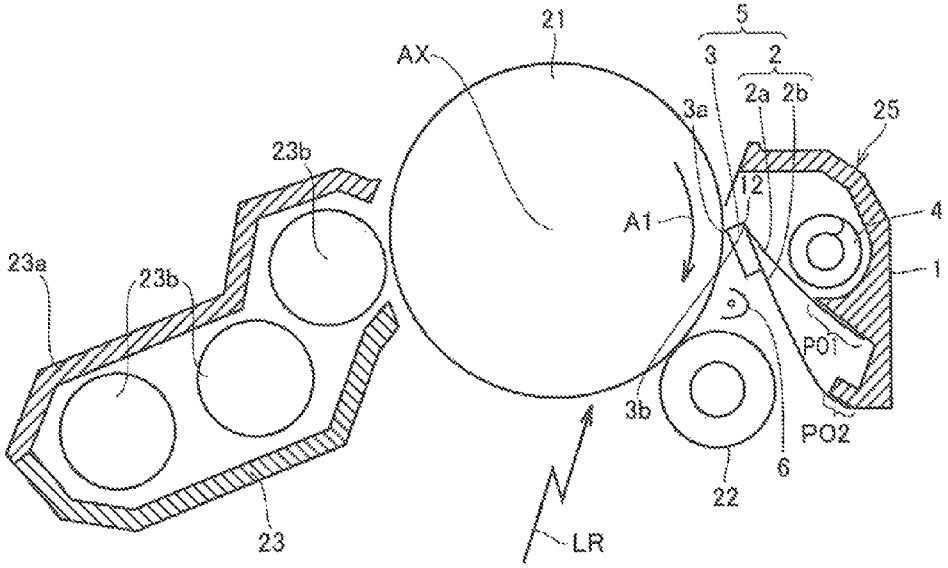
FIG. 2 shows an enlarged drawing of the arbitrary drum unit in FIG. 1.

FIG. 2 shows an enlarged drawing of the arbitrary drum unit in FIG. 1.

Referring to FIG. 2, photo conductor cleaning device 25 includes device main body 1 (an example of a cleaning device main body), collect screw 4, blade 5, and neutralization device 6. Collect screw 4 is installed in the inner part of device main body 1. Blade 5 is fixed on device main body 1, and projects to photo conductor 21. Neutralization device 6 is provided at a downstream side of the contact part between blade 5 and photo conductor 21 and at an upstream side of electrostatic charging device 22.

Blade 5 includes supporting sheet metal plate 2 (an example of a supporting part), and tip blade 3 (an example of an elastic component). Supporting sheet metal plate 2 supports tip blade 3. Supporting sheet metal plate 2 is flexible, to energizes tip blade 3 toward photo conductor 21 by its properties of a spring. By the energization force, supporting sheet metal plate 2 makes edge portion 3*a* of tip blade 3 contact with photo conductor 21. Supporting sheet metal plate 2 can be made of a strip plate of spring steel, stainless steel, brass, phosphor bronze, beryllium copper, or the like.

As shown by FIG. 2, supporting sheet metal plate 2 has a L-shaped cross section, which is formed by arm portions 2*a* and 2*b*, and a bending portion 12. One end of arm portion 2*a* and one end of arm portion 2*b* are fixed to device main body 1 at two fixing portions PO1 and PO2 which are provided at different locations with respect to the cross section perpendicular to the axis of rotation of photo conductor drum 12. Each of the two fixing portions PO1 and PO2 makes surface contact with each of ends of supporting sheet metal plate 2, so that the both ends of supporting sheet metal plate 2 are supported by the two fixing portions PO1 and PO2. Each of arm portions 2*a* and 2*b* has substantially a straight-line shape. Arm portion 2*a* extends from fixing portion PO1 toward photo conductor 21. Arm portion 2*b* extends from fixing portion PO2 inward photo conductor 21. Bending portion 12 is a portion which is bent at an arbitrary angle, and constitutes a boundary between arm portion 2*a* and arm portion 2*b*.

Bending portion 12 is preferably located at the center of the developed length of supporting sheet metal plate 2 (the length of arm portions 2*a* and 2*b* of FIG. 2, when the arm portions 2*a* and 2*b* are expanded to a flat plane shape). When bending portion 12 is provided at the censer of the developed length, the natural frequency of the portion between bending portion 12 and fixing portion PO1 (arm portion 2*a*) and the natural frequency of the portion between bending portion 12 and fixing portion PO2 (arm portion 2*b*) can be same. In consequence, the producing sound can be suppressed.

Tip blade 3 is supported at the location between the two fixing portions PO1 and PO2 in the extending direction of supporting sheet metal, plate 2. Tip blade 3 is fixed adjacent to bending portion 12 of supporting sheet metal plate 2, by hot-melt adhesive agent or the like. Edge portion 3*a* of tip blade 3 is pressed against the surface of photo conductor 21. Herewith, tip blade 3 scrapes transfer remaining toner on the surface of photo conductor 21. Tip blade 3 is fixed, so that edge portion 3*b* which is opposite to edge portion 3*a* which makes contact with photo conductor 21, is adjacent to an edge portion of bending portion 12 of supporting sheet metal plate 2. Tip blade 3 keeps contact with photo conductor 21, against the rotational direction of photo conductor 21 (the direction shown by arrow A1) (hereinafter, it is referred to as the counter direction). Tip blade 3 is made of an elastic body. For example, tip blade 3 consists of a polyurethane rubber which was processed into a tip shape. For example, tip blade 3 is made by a centrifugal molding machine.

The end of tip blade 3 is not necessarily fixed at the location being aligned with the edge portion of bending portion 12 of supporting sheet metal plate 2. The end of tip blade 3 is preferably located near bending portion 12. Herewith, by using bending portion 12 as a mark, the position, of tip blade 3 can be adjusted simply, so that the effective abutting angle of tip blade 3 with respect to photo conductor 21 can be configured within the proper range.

Collect screw 4 conveys (collects) toner scraped by tip blade 3 from photo conductor cleaning device 25 to a disposal toner box which is not shown in the figures.

Neutralization device 6 comprises of a plurality of LEDs (Light Emitting Diodes) arranged in the longitudinal direction, for example. Neutralization device 6 decreases the electrical potential which remains on the surface of photo conductor 21, by irradiating photo conductor 21 with the light. Herewith, when the next image forming is to be performed, a history (a memory image) of the previous image does not remain on the surface of photo conductor 21.

Developing device 23 includes developer tank 23*a*, developing roller (developing sleeve) 23*b*, and agitate circulation screw 23*c*. Developer tank 23*a* stores developer which consists of toner and carrier. Developing roller 23*b* is cylindrical, and stores magnetic poles in the inner part. Developing roller 23*b* conveys toner to a position on the surface of photo conductor 21 which feces developing roller 23*b*, by rotating at the location facing the image supporting body. Agitate circulation screw 23*c* is placed in developer tank 23*a*. When toner which compensates the amount of toner consumed by developing is supplied into developer tank 23*a*, agitate circulation screw 23*c* mixes the toner and the carrier, to apply a predetermined electrostatic charging amount.

The abrasion quantity of edge portion. 3*a* of tip blade 3 increases in response to the distance of frictional rubbing against photo conductor 21. When the abrasion amount of tip blade 3 exceeds a predetermined amount, transfer remaining toner of the surface of photo conductor 21 slips through tip blade 3, so that image noise of poor cleaning occurs. Normally, by forming a lubricant coated layer on the surface of photo conductor 21, a friction coefficient of the surface of photo conductor 21 is reduced, so that the frictional force acting between the surface of photo conductor 21 and tip blade 3 is reduced. In consequence, lifes of photo conductor 21 and a photo conductor cleaning device 25 are prolonged.

The lubricant coated layer is formed, by suppling lubricant particles onto photo conductor 21, and turning the lubricant particles to a thin film, when the lubricant particles passes through the nip portion between tip blade 3 and photo conductor 21. A method for providing lubricant particles onto an image supporting body comprises adding lubricant particles to toner, as external additive, and providing lubricant particles from developing device 23 to photo conductor 21 when developing. Lubricant particles comprise of inorganic stearic acid compound microparticles, such as zinc stearate microparticles, and aluminum stearate microparticles. The lubricant particles may comprise of only one kind of particle, or 2 or more kinds of material.

Figure 3:
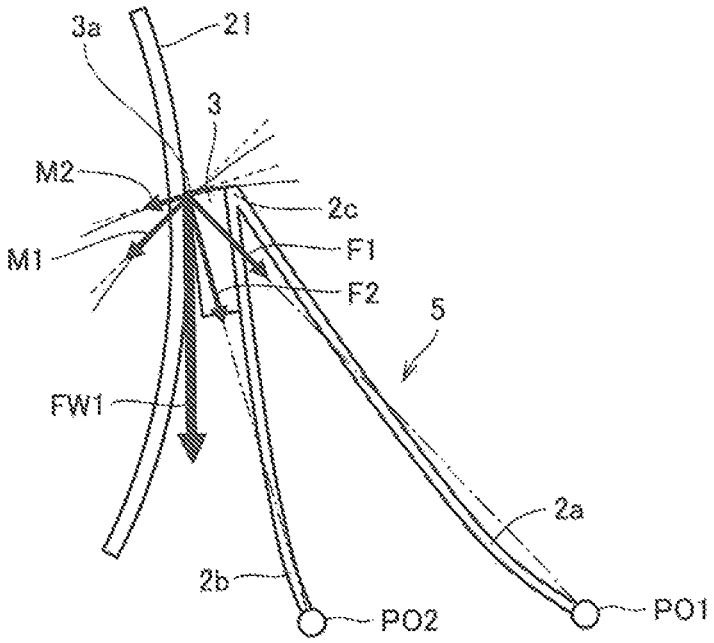
FIG. 3 shows a force diagram for the force acting on tip blade 3, according to the first embodiment of this invention.

FIG. 3 shows a force diagram for the force acting on tip blade 3, according to the first embodiment of this invention. In FIG. 2, each of fixing portions PO1 and PO2 is shown as a portion which has a length. In FIGS. 3 to 9, each of fixing portions PO1 and PO2 is shown as a point. In FIGS. 3 to 9, the points of fixing portions PO1 and PO2 correspond to nearest points of fixing portions PO1 and PO2 from the center of supporting sheet metal plate 2 in FIG. 2 (the left ends of fixing portions PO1 and PO2 in FIG. 2).

Referring to FIG. 3, edge portion 3*a* of tip blade 3 receives frictional force FW1 caused by contact with photo conductor 21. Frictional force FW1 can be resolved into compression forces F1 and F2 and rotative forces M1 and M2. Compression force F1 is toward fixing portion PO1 from edge portion 3*a*, and compresses arm portion 2*a*. Compression force F2 is toward fixing portion PO2 from edge portion. 3*a*, and compresses arm portion 2*b*. Rotative force M1 is toward the direction being perpendicular to compression force F1, and makes tip blade 3 dig into photo conductor 21. Rotative force M2 is toward the direction being perpendicular to compression force F2, and makes tip blade 3 dig into photo conductor 21.

According to the embodiment, frictional force FW1 is resolved into two compression forces F1 and F2 and rotative forces M1 and M2. Arm portion 2*a* receives compression force F1 and rotative force M1. Arm portion 2*b* receives compression force F2 and rotative force M2. In this manner, blade 5 receives the resolved frictional force. Hence, when the frictional force between photo conductor 21 and tip blade 3 increases, the increment of the contacting-force which makes tip blade 3 contact with photo conductor 21 is suppressed. In consequence, the increment of the abrasion amount of photo conductor 21 and tip blade 3 can be suppressed, so that lifes of photo conductor 21 and tip blade 3 can be prolonged.

Figure 4:
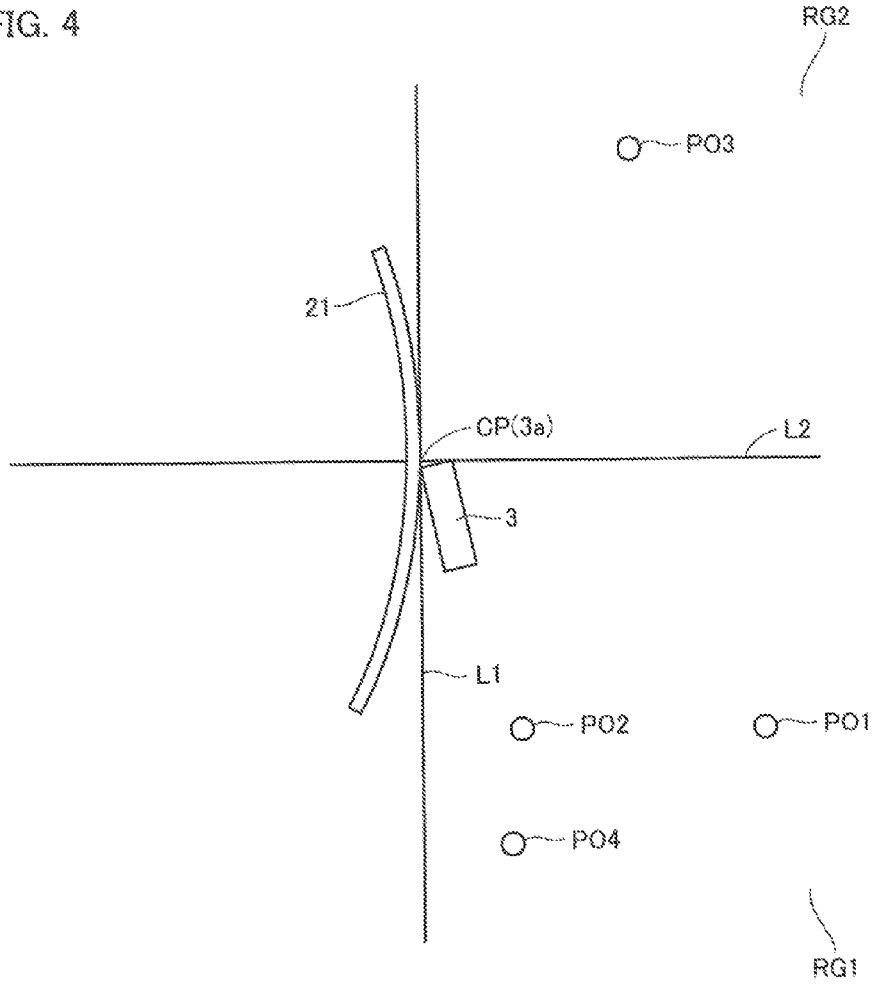
FIG. 4 shows the relationship between the locations of fixing portions PO1 and PO2 and the quadrants, according to the first and the second embodiments of this invention.

FIG. 4 shows the relationship between the locations of fixing portions PO1 and PO2 and the quadrants, according to the first and the second embodiments of this invention.

Referring to FIG. 4, four quadrants are provided by tangent line L1 of photo conductor 21 and the orthogonal line L2, wherein the tangent line L1 of photo conductor 21 is through contact point CP between tip blade 3 (photo conductor cleaning device 25) and photo conductor 21, and the orthogonal line L2 is through the contact point CP and perpendicular so the tangent line L1, as shown by the cross section of FIG. 2. The two fixing portions PO1 and PO2 are in the same quadrant RG1.

When the two fixing portions PO1 and PO2 belong to the same quadrant RG1, rotative forces M1 and M2 become force in the direction to make tip blade 3 dig into photo conductor 21, and tip blade 3 receives comparatively large rotative force. Since the up blade 3 normally comprises of rubber such as polyurethane, the tip blade 3 has viscosity. Therefore, it becomes easier to make abnormal noise being referred to as producing sound, due to an oscillation of photo conductor cleaning device 25. The producing sound tends to occur easily, when the repulsion elasticity which is one of material characteristics of tip blade 3 is large. Therefore, in the embodiment, tip blade 3 is preferably made of material of which the repulsion elasticity is small. However, material of which the repulsion elasticity is small tends not to perform proper cleaning performance, unless the material does not receive large contacting force. Hence, the effect to reduce the abrasion amount of photo conductor 21 and lip blade 3 is small. On the other hand, when the two fixing portions PO1 and PO2 belong to the same quadrant RG1, the two fixing portions PO1 and PO2 can be arranged at comparative near locations. Hence, the device can be downsized. Therefore, photo conductor cleaning device 25 according to the embodiment is suitable for being installed in an image forming apparatus (for example, an MFP or a printer) which is small and has comparatively a short lifetime.

On the other hand, the first and the second comparative examples which will be explained as follows, cannot obtain the above-mentioned effect of the embodiment.

Figure 5:
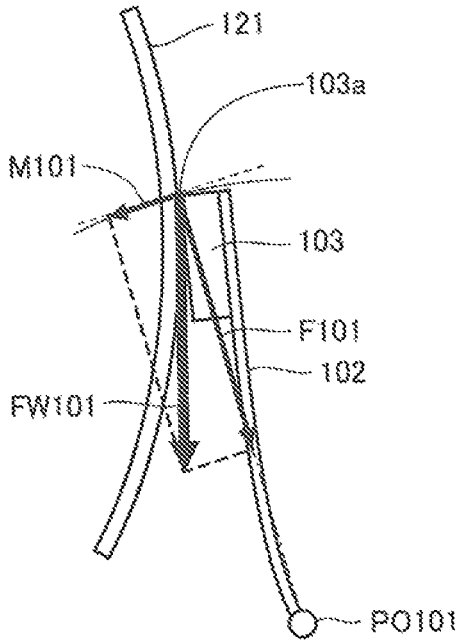
FIG. 5 shows a force diagram of the force acting on the tip blade of the photo conductor cleaning device, according to the first comparative example.

FIG. 5 shows a force diagram of the force acting on the tip blade of the photo conductor cleaning device, according to the first comparative example.

Referring to FIG. 5, according to the first comparative example, supporting sheet metal plate 102 which supports tip blade 103 is fixed to the device main body (which is not shown in Figures) of the photo conductor cleaning device, by only one fixing portion PO101, as shown by the cross section of FIG. 5.

Edge portion 103*a* of tip blade 103 receives frictional force FW101 which occurs between edge portion 103*a* and photo conductor 121. Frictional force FW101 can be resolved into compression force F101 and rotative force M101. Compression force F101 is toward fixing portion PO101 from edge portion 103*a*, to compresses supporting sheet metal plate 102. Rotative force M101 is toward the direction perpendicular to compression force F101, to make tip blade 103 dig into photo conductor 121.

According to the structure of this comparative example, one supporting part (arm portion) 102 receives all the compression force F101 and rotative force M101. Therefore, when the fictional force between photo conductor 121 and tip blade 103 increases, the increment of the contacting force which makes tip blade 103 contact with photo conductor 121 cannot be prevented, so that the abrasion amounts of photo conductor 121 and tip blade 103 increases. It makes the lifetimes shorten.

Figure 6:
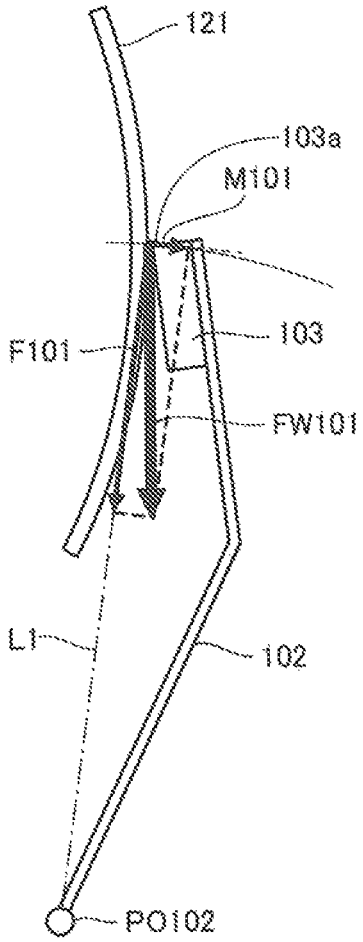
FIG. 6 shows a force diagram of the force acting on the tip blade of the photo conductor cleaning device, according to the second comparative example.

FIG. 6 shows a force diagram of the force acting on the tip blade of the photo conductor cleaning device, according to the second comparative example.

Referring to FIG. 6, according to the second comparative example, supporting sheet metal plate 102 which supports tip blade 103 is fixed to the device main body (which is not shown in Figures) of the photo conductor cleaning device, by only one fixing portion PO102, as shown by the cross section of FIG. 6. Fixing portion PO102 is placed at the side of photo conductor 121 with respect to tangent line L1.

Edge portion 103*a* of tip blade 103 receives frictional force FW101 which is between edge portion 103*a* and photo conductor 121. Frictional force FW101 can be resolved into compression force F101 and rotative force M101. Compression force F101 is toward fixing portion PO102 from edge portion 103*a*, to compress supporting sheet metal plate 102. Rotative force M101 is toward the direction perpendicular to compression force F101, to pull tip blade 103 away from photo conductor 121.

According to the structure of this comparative example, rotative force M101 is toward the direction to pull tip blade 103 away from photo conductor 121. Hence, when frictional force between photo conductor 121 and tip blade 103 increases, the contacting force which makes tip blade 103 contact with photo conductor 121 decreases, so that the abrasion amounts of photo conductor 121 and tip blade 103 decreases. However, various components such as an electrostatic charging voltage are normally controlled, on the basis that the abrasion amount of photo conductor 21 is decreased by a prescribed amount in response to the number of revolutions of photo conductor 21. Hence, when the abrasion amounts of photo conductor 121 and tip blade 103 decrease to the smaller than expected, an image defectiveness such as a fogging (a phenomenon in which a non-image part on a surface of a photo conductor is developed with toner) is likely to occur.

The Second Embodiment

Figure 7:
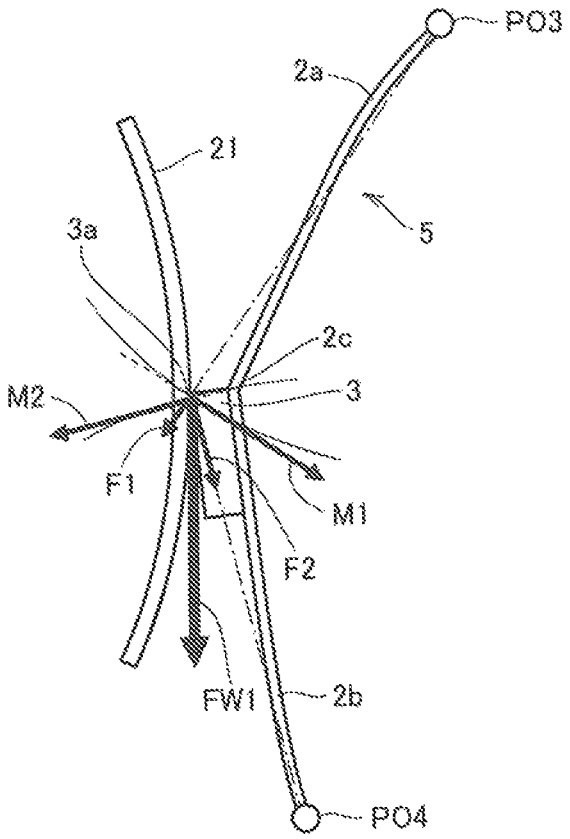
FIG. 7 shows a force diagram of the force acting on tip blade 3, according to the second embodiment of this invention.

FIG. 7 shows a force diagram of the force acting on tip blade 3, according to the second embodiment of this invention.

Referring to FIGS. 4 and 7, supporting sheet metal plate 2 according to the embodiment is fixed to device main body 1 at two fixing portions PO3 and PO4 which are installed at different locations. The two fixing portions PO3 and PO4 belong to different quadrants. Fixing portion PO3 belongs to quadrant RG2. Fixing portion PO4 belongs to quadrant RG1. Quadrant RG1 and Quadrant RG2 are contiguous.

Edge portion 3*a* of tip blade 3 receives frictional force FW1 which is caused by contact between photo conductor 21 and edge portion 3*a*. Frictional force FW1 can be resolved into compression forces F1 and F2 and relative forces M1 and M2. Tensile force F1 is in a direction from fixing portion PO3 toward edge portion 3*a*, and pulls arm portion 2*a*. Compression force F2 is toward fixing portion PO4 from edge portion 3*a*, and compresses arm portion 2*b*. Rotative force M1 is in the direction perpendicular to the direction of tensile force F1, and pulls tip blade 3 away from photo conductor 21. Rotative force M2 is in the direction perpendicular to the direction of compression force F2, and dig tip blade 3 into photo conductor 21.

In this manner, the compression forces and the tensile forces which is the reaction force of the compression forces act on edge portion 3*a*. The rotative force in the direction to dig into photo conductor 21 and the reaction force which is the rotative force in the direction to pull away from photo conductor 21 act on edge portion 3*a*. Herewith, when frictional force between photo conductor 21 and tip blade 3 increases, the increment of the contacting force which makes tip blade 3 contact with photo conductor 21 is suppressed, so that the abrasion of photo conductor 21 and tip blade 3 can be prevented.

When the two fixing portions PO3 and PO4 belong to different quadrants, the resultant force of rotative forces M1 and M2 is smaller than the first embodiment. Therefore, even if tip blade 3 is made of high repulsion elastic material, the occurrence of the producing sound can be prevented. The high repulsion elastic material delivers superior cleaning performance. Hence, the contacting force which makes tip blade 3 contact with photo conductor 21 can be designed to a small force, to prevent abrasion of photo conductor 21 and tip blade 3, so that the lifes can be prolonged. On the other hand, since the two fixing portions PO3 and PO4 should be placed at different quadrants, the device becomes larger. Therefore, photo conductor cleaning device 25 of this embodiment is suitable for an image forming apparatus which is large and for which a long lifetime is requested (for example, an industrial printing machine), or the like.

The structures of the image forming apparatus according to the embodiment other than the above are similar to the structures of the image forming apparatus according to the first embodiment. Hence, the same numerals are provided for same components, and the explanations are not repeated.

The Modification of the Second Embodiment

Figure 8:
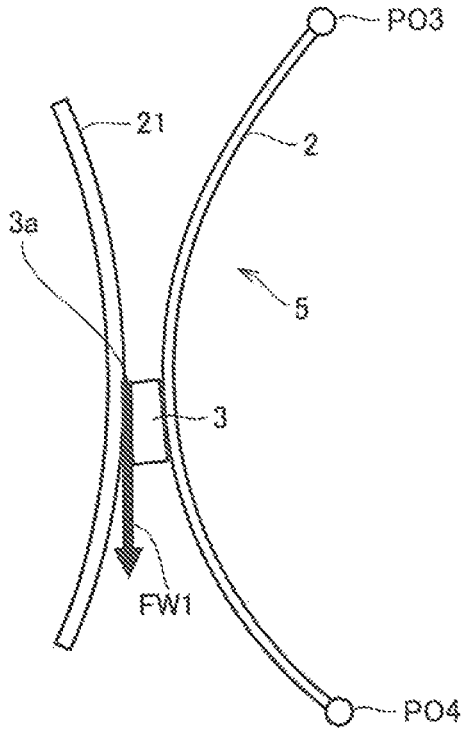
FIG. 8 shows a force diagram of the force acting on tip blade 3, according to the first modification of the second embodiment.

FIG. 8 shows a force diagram of the force acting on tip blade 3, according to the first modification of the second embodiment.

Referring to FIG. 8, supporting sheet metal plate 2 according to the first modification does not include a bending portion, and has overall a bent arc shape. Tip blade 3 is fixed at the portion of supporting sheet metal plate 2 which is most protruded toward photo conductor 21.

This modification has a similar effect to the second embodiment. In addition, a bending step in manufacturing supporting sheet metal plate 2 is unnecessary, so that the productivity can be improved.

Figure 9:
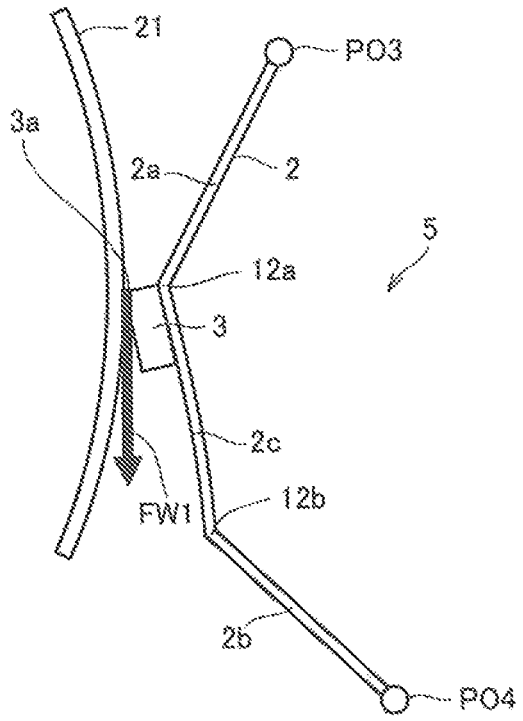
FIG. 9 shows a force diagram of the force acting on tip blade 3, according to the second modification of the second embodiment.

FIG. 9 shows a force diagram of the force acting on tip blade 3, according to the second modification of the second embodiment.

Referring to FIG. 9, supporting sheet metal plate 2 according to the second modification includes three arm portions 2*a*, 2*b* and 2*c*, and two bending portions 12*a* and 12*b*. Each of arm portions 2*a*, 2*b* and 2*c* is substantially straight line shaped. Arm portion 2*a* extends from fixing portion PO3 toward bending portion 12*a*. Arm portion 2*b* extends from fixing portion PO4 toward bending portion 12*b*. Arm portion 2*c* is located between bending portion 12*a* and bending portion 12*b*. Each of bending portions 12*a* and 12*b* is a folded portion at an arbitrary angle. Bending portion 12*a* constitutes a boundary between arm portion 2*a* find arm portion 2*c*. Bending portion 12*b* constitutes a boundary between arm portion 2*b* and arm portion 2*c*. The end of tip blade 3 is preferably located near bending portion 12*a* or 12*b*.

This modification has a similar effect to the second embodiment. In addition, since supporting sheet metal plate 2 includes a plurality of bending portions 12*a* and 12*b*, it is easy to design an effective abutting angle of tip blade 3 with respect to photo conductor 21, rotative force of tip blade 3, or the like, as a desired value. In response to the toner being used and the photo conductor, the structure of photo conductor cleaning device 25 can be designed as a structure for emphasizing cleaning performance, or a structure for emphasizing peel resistance. It can broaden the range of image forming apparatuses to which photo conductor cleaning device 25 can be applicable.

The structures of the image forming apparatus according to the above-mentioned modification other than the above are similar to the structures of the image forming apparatus according to the second embodiment. Hence, the same numerals are provided for same components, and the explanations are not repeated.

Embodiments

To confirm the efficacy of this invention, the inventor of this patent application prepared image forming apparatuses of comparative example A, comparative example B, the invention example C, and the invention example D. For each of the image forming apparatuses, the abrasion of the photo conductor, the abrasion of the tip blade, the fogging, the earner adhesion (a phenomenon in which carrier of developer adheres to an image area in an electrostatic latent image or the like), the producing sound, the peeling, and the contact between a supporting part and a photo conductor are evaluated.

As common parts of image forming apparatuses according to comparative example A, comparative example B, this invention example C, and this invention example D, bizhub e554e (A4Y 55 sheets/minute) made by KONICA MINOLTA BUSINESS TECHNOLOGIES Co., Ltd. is used. Zinc stearate was used as the solid lubricant added to toner. According to comparative example A, as the photo conductor cleaning device of the above mentioned image forming apparatus, the structure of the first comparative example shown in FIG. 5 was used. According to comparative example B, as the photo conductor cleaning device of the above mentioned image forming apparatus, the structure of the second comparative example shown in FIG. 6 was used. According to this invention example C, as the photo conductor cleaning device of the above mentioned image forming apparatus, the structure of the first embodiment shown in FIG. 3 was used. According to this invention, example D, as the photo conductor cleaning device of the above mentioned image forming apparatus, the structure of the second embodiment shown in FIG. 7 was used.

After printing a document image of which the coverage of each of YMCK colors is 25% (condition 1), 5% (condition 2), or 1% (condition 3) on 150,000 sheets which are an A4Y type, under 23 degree Celsius*65% RH environment, the abrasion of the photo conductor, the abrasion of the tip blade, and the logging were evaluated.

The abrasion of the photo conductor was evaluated in the following manner. A film thickness measuring device (FISCHERSCOPE made by Fischer corporation) equipped with an eddy electrical current type probe was used. After about 150,000 sheets were printed, the file thickness of the surface of the photo conductor was measured. The differential of the film thickness was calculated as the abrasion amount. When the calculated abrasion amount is less than 5 μm, the condition is evaluated as AA. When the calculated abrasion amount is more than or equal to 5 μm and less than 10 μm, the condition is evaluated as A. When the calculated abrasion amount is more than or equal to 10 μm and less than 15 μm, the condition is evaluated as B. When the calculated abrasion amount is more than or equal to 15 μm, the condition is evaluated as C.

The abrasion of the tip blade was evaluated in the following manner. By using a laser microscope (VK9500, made by Keyence), the profile of the cross section of the surface of the tip blade was made, after about 150,000 sheets were printed, to measure the abrasion region. When the maximum of the abrasion region in the whole area in the longitudinal direction is less than 5 μm, it is evaluated as A. When the maximum of the abrasion region in the whole area in the longitudinal direction is more than or equal to 5 μm and less than 10 μm, it is evaluated as B. When the maximum of the abrasion region in the whole area in the longitudinal direction is more than or equal to 10 μm, it is evaluated as C.

The fogging is evaluated in the following manner. After 150,000 sheets were printed, a solid white document image (a document image in which the coverage of each of YMCK colors is 0%) was printed. When a fogging did not occur, the printed image is evaluated as A. When a fogging slightly occurred, the printed image is evaluated as B. When a fogging definitely occurred, the printed image is evaluated as C.

The carrier adhesion, the producing sound, the peeling, and the contact between the supporting part and the photo conductor were evaluated by printing a solid white document image (a document image in which the coverage of each of YMCK colors is 0%) on 200 sheets of A4Y, after printing a document image of which the coverage of each of YMCK colors is 5% on 150,000 sheets of A4Y, under the environment of 30 degree Celsius*85% RH.

The carrier adhesion was evaluated in the following manner. After 150,000 sheets were printed, a solid white document image was printed. When a carrier adhesion did not occur on the solid white image, the case is evaluated as A. When a carrier adhesion slightly occurred, the case is evaluated, as B. When a carrier adhesion definitely occurred, the case is evaluated as C.

The producing sound was evaluated in the following manner. During printing of a solid white document image, when a producing sound did not occur, the case is evaluated as A. When a producing sound, slightly occurred, the case is evaluated as B. When a producing sound definitely occurred, the case is evaluated as C. The producing sounds were evaluated making a distinction between the case when a solid white image is being printed on the first to the 100th sheets (condition 4), and the case when a solid white image is being printed on the 101th to the 200th sheets (condition 5).

The peeling was evaluated in the following manner. After a solid white document image was printed (condition 6), the drum unit was disassembled. From the standpoint of appearance, when a peeling did not occur, the ease was evaluated as A. From the standpoint of appearance, when a peeling occurred, the case was evaluated as C.

The contact between the supporting part and the photo conductor was evaluated in the following manner. After a solid white document image was printed (condition 6), the drum unit was disassembled. From the standpoint of appearance, when streaky scratches did not occur on the surface of the photo conductor, the case is evaluated as A. From the standpoint of appearance, when streaky scratches occurred, the case is evaluated as C. The reasons for this follow, when the supporting part and the photo conductor come into contact with each other, streaky scratches occurs on the surface of the photo conductor.

FIG. 10 shows the evaluation result table of comparative example A, according to the embodiment of this invention.

Referring to FIG. 10, under the 5% coverage condition (condition 2) as a standard condition, problems were not found. Under coverage condition (condition 1), since the coverage and the amount of lubricant which is supplied along with toner were small, the factional force between the photo conductor and the tip blade was large. Hence, the rotative force in the direction in which the tip blade digs into the photo conductor became large, and the contacting force of the tip blade increased. In consequence, the abrasion of each of the photo conductor and the cleaning parts increased. Under 23% coverage condition (condition 3), since the amount of the lubricant being supplied along with toner was large, the abrasion of each of the photo conductor and the cleaning parts was reduced. However, when the abrasion of the photo conductor decreases, the film thickness of the photo conductor increases to more than the expected film thickness. Therefore, the electrostatic capacitance of the photo conductor decreases, and the surface electrical potential decreases. In consequence, a fogging occurred. Further, significant producing sounds occurred (conditions 4 and 5), and the supporting part and the image supporting body made contact with each other (condition 6).

FIG. 11 shows the evaluation result table of comparative example B, according to the embodiment of this invention.

Referring to FIG. 11, under 5% coverage condition (condition 2) as a standard condition, the problems were not found. Under 1% coverage condition (condition 1), the abrasion of each of the photo conductor and the cleaning parts was smaller than comparative example A, and the problem was not found. Under 25% coverage condition (condition 3), a fogging significantly occurred much more than comparative example A. Furthermore, when the frictional force between the photo conductor and the tip blade increases, the rotative force in the direction in which the tip blade digs into the photo conductor is suppressed, and the contacting force of the tip blade become small. Therefore, a peeling did not occur, and the supporting part and the image supporting body did not make contact with each other (condition 6). Even though the producing sound was reduced, the producing sound could not completely be suppressed (conditions 4 and 5).

FIG. 12 shows the evaluation result table of the invention example C, according to the embodiment of this invention.

Referring, to FIG. 12, under all the 1% coverage condition (condition 1), 5% condition (condition 2), and 25% condition (condition 3), the problems were not found. Furthermore, the producing sound was suppressed (conditions 4 and 5). A peeling, and a contact between the supporting part and the image supporting body did not occur (condition 6%), so that a sophisticated cleaning device can be obtained.

FIG. 13 shows the evaluation result table of the invention example D, according to the embodiment of this invention.

Referring to FIG. 13, under all the 1% coverage condition (condition 1), 5% condition (condition 2), and 25% condition (condition 3), the problems were not found. Furthermore, the producing sound was completely suppressed (conditions 4 and 5), and a peeling and a contact between the supporting part and the image supporting body did not occur (condition 6%), so that a sophisticated cleaning device can be obtained.

The Effect of the Embodiments

According to the embodiments, a cleaning device which can prolong the life, can be provided. Therefore, a sophisticated cleaning device can be provided.

[Others]

In the above mentioned embodiments, and modifications, the supporting part may rotate around at least one of the two fixing portions. By making the fixing portion rotatable, the rotational force easily occurs. Further, the time needed from when the rotational force occurred to when the reaction force of the rotational force occurs shortens, so that producing, sound can be effectively suppressed.

The cleaning device of the above mentioned embodiment removes substances adhered to the surface of the photo conductor. As substitute for substances adhered to the surface of the photo conductor, the cleaning device may remove substances adhered to the surface of a transfer belt, such as an intermediate transfer belt.

Although the present invention has been described and illustrated in detail, it is clearly understood that the same is by way of illustrated and example only and is not to be taken by way limitation, the scope of the present invention being interpreted by terms of the appended claims.

What is claimed is:

1. A cleaning device for removing substances adhered to a surface of an image supporting body, wherein the image supporting body moves around an axis of rotation, comprising:

a cleaning device main body, an elastic component, and a supporting part which is flexible, holds the elastic component, and makes the elastic component contact with the image supporting body, the supporting part possessing a first end and a second end opposite the first end, wherein the supporting part is fixed to the cleaning device main body by two fixing portions which are located at different locations, as seen in a cross section perpendicular to the axis of rotation, and the supporting part is fixed at both the first end and the second end of the supporting part by the two fixing portions.

2. The cleaning device according to claim 1, wherein when four quadrants are defined by a tangent line of the image supporting body at a contact point between the elastic component and the image supporting body, and an orthogonal line through the contact point and being perpendicular to the tangent line, as seen in the cross section perpendicular to the axis of rotation, the two fixing portions belong to different quadrants.

3. The cleaning device according to claim 1, wherein when four quadrants are defined by a tangent line of the image supporting body at a contact point between the elastic component and the image supporting body, and an orthogonal line through the contact point and being perpendicular to the tangent line, as seen in the cross section perpendicular to the axis of rotation, the two fixing portions belong to adjacent quadrants.

4. The cleaning device according to claim 1, wherein the elastic component makes contact with the image supporting body, against a rotational direction of the image supporting body.

5. The cleaning device according to claim 1, wherein the supporting part includes a bending portion which is bent at an arbitrary angle, as seen in the cross section perpendicular to the axis of rotation.

6. The cleaning device according to claim 5, wherein the bending portion is present at a center of a developed length of the supporting part.

7. The cleaning device according to claim 5, wherein an end of the elastic component is located near the bending portion.

8. The cleaning device according to claim 1, wherein the supporting part rotates around at least one of the two fixing portions.

9. An image forming apparatus comprising the cleaning device according to claim 1.

10. A cleaning device for removing substances adhered to a surface of an image supporting body, wherein the image supporting body moves around an axis of rotation, comprising:

a cleaning device main body, the cleaning device main body comprising an inner surface, an elastic component, and a supporting part which is flexible, holds the elastic component, and makes the elastic component contact with the image supporting body, the supporting part possessing a first end, a second end opposite the first end, and an outer surface, wherein the outer surface of the supporting part is fixed directly to the inner surface of the cleaning device main body at two fixing portions which are located at different locations, as seen in a cross section perpendicular to the axis of rotation, and the supporting part is fixed at both the first end and the second end of the supporting part at the two fixing portions.

* * * * *